US010954627B2

(12) United States Patent
Rees et al.

(10) Patent No.: US 10,954,627 B2
(45) Date of Patent: Mar. 23, 2021

(54) CONFORMABLE COLORED MULTILAYER COMPOSITE FABRICS

(71) Applicant: ENGINEERED FLOORS LLC, Dalton, GA (US)

(72) Inventors: John Joseph Matthews Rees, Chattanooga, TN (US); Stephen Tsiarkezos, Elkton, MD (US); Dimitri Zafiroglu, Centreville, DE (US)

(73) Assignee: ENGINEERED FLOORS LLC, Dalton, GA (US)

( * ) Notice: Subject to any disclaimer, the term of this patent is extended or adjusted under 35 U.S.C. 154(b) by 0 days.

(21) Appl. No.: 16/744,863

(22) Filed: Jan. 16, 2020

(65) Prior Publication Data

US 2020/0232159 A1 Jul. 23, 2020

Related U.S. Application Data

(60) Provisional application No. 62/793,619, filed on Jan. 17, 2019.

(51) Int. Cl.

| | |
|---|---|
| ***D06P 1/00*** | (2006.01) |
| ***D06P 5/22*** | (2006.01) |
| ***D06P 7/00*** | (2006.01) |
| ***D05C 17/02*** | (2006.01) |
| ***D06P 1/44*** | (2006.01) |
| *D06Q 1/06* | (2006.01) |

(52) U.S. Cl.

CPC ..... *D06P 1/0008* (2013.01); *D05C 17/026* (2013.01); *D06P 1/445* (2013.01); *D06P 5/22* (2013.01); *D06P 7/00* (2013.01); *D06Q 1/06* (2013.01)

(58) Field of Classification Search

CPC .. D06P 1/0008; D06P 3/00; D06P 7/00; D06P 1/00; D06P 5/15; D06P 1/445; D06P 5/003; D06Q 1/06

USPC ..... 8/467

See application file for complete search history.

(56) References Cited

U.S. PATENT DOCUMENTS

| | | | | |
|---|---|---|---|---|
| 3,922,445 | A * | 11/1975 | Mizuno | D06P 5/004 8/467 |
| 5,503,076 | A | 4/1996 | Yeo | |
| 8,350,880 | B2 | 1/2013 | Dinescu et al. | |
| 2004/0022994 | A1 | 2/2004 | Higgins et al. | |
| 2004/0172773 | A1 | 9/2004 | Kang et al. | |
| 2007/0298209 | A1 | 12/2007 | Kohlman et al. | |
| 2008/0196813 | A1 | 8/2008 | Doney et al. | |

(Continued)

OTHER PUBLICATIONS

International Search Report and Written Opinion in corresponding/related International Application No. PCT/US2020/013864 dated Jun. 3, 2020.

*Primary Examiner* — Eisa B Elhilo

(74) *Attorney, Agent, or Firm* — Patent Portfolio Builders PLLC

(57) ABSTRACT

An adhesive layer carrying a uniform color or a color-scheme is placed within or under a colored or color-printed conformable fabric that is simultaneously or subsequently molded into a three-dimensional shape or embossed with a three-dimensional pattern. The thermoplastic adhesive layer proceeds towards the fabric surface and matches or masks the color gaps opened on the surface by molding or embossing. The fabric can also be laminated to a backing during the molding or embossing process.

35 Claims, 6 Drawing Sheets

(56) References Cited

U.S. PATENT DOCUMENTS

| | | | | |
|---|---|---|---|---|
| 2018/0044852 | A1* | 2/2018 | Downs | D06P 5/2033 |
| 2019/0032254 | A1 | 1/2019 | Zafiroglu et al. | |

* cited by examiner

CONFORMABLE COLORED MULTILAYER COMPOSITE FABRICS

CROSS-REFERENCE TO RELATED APPLICATIONS

The present application claims priority to U.S. Provisional Patent Application No. 62/793,619, filed Jan. 17, 2019, the entire contents of which are incorporated herein by reference.

TECHNICAL FIELD

Embodiments of the subject matter disclosed herein relate to colored or printed composite textile fabrics used in flooring, surface coverings, upholstery, and other uses.

BACKGROUND

When a fabric is printed with a uniform color or with a color pattern applied to the top surface, the applied color or color pattern does not always extend into the lower strata of the fabric. In portions of the fabric where the color or color pattern does not extend into the lower strata, the original color of the fibers or yarns of the fabric is exposed at gaps created by the parting of the fibers or yarns. Exposure of the original color of the fibers degrades the appearance of the color or color pattern applied to the top surface.

Fabrics having a uniform surface color or color scheme and that are conformable, moldable or embossable with a relatively deep heated tool tend to show undesirable gaps at the stretched areas. These undesirable gaps result from the parting of the fibers or yarns of the fabrics in the stretched areas. The gaps formed during embossing can also create holes at the peripheries of the depressed areas of the fabric and can extend to the surface of the fabric at elevated areas as the top surface is stretched by the embossing action. In addition to parting of the fibers occurring as a result of molding or embossing, parting of the fibers or yarns can occur over time during use of the fabric.

When the fabric is attached to a backing layer during embossing, the backing can become visible at the gaps created by the parting of the fibers or yarns. Unless the exposed backing has a uniform color matching the color or color pattern applied to the top surface, the exposed backing creates an undesirable contrast with the top surface of the fabric. As any backing applied to the fabric is typically required to have special properties, coloring that backing to match the color or color pattern applied to the top surface is complicated, impractical, and costly.

Therefore, improved fabrics and methods for making improved fabrics that are less complicated and more economical are desired where the improved fabrics have a uniform color or color pattern on the top surface and that avoid or mask gaps or holes or gaps that cause a loss of color or printed design uniformity on the top surface. These improved fabrics would include conformable, moldable, and deeply embossable composite fabrics.

SUMMARY

Exemplary embodiments are directed to conformable, colored multilayer textile fabric composites, to methods of making conformable, colored multilayer composite textile fabrics, and to methods for using the conformable, colored multilayer composite textile fabrics. In an exemplary embodiment of a method for making a conformable, colored multilayer composite textile fabric, a colored or color-carrying layer is combined with a textile fabric. Preferably, the colored or color-carrying layer is a low-melting colored or color-carrying layer (hereinafter "LMCC"). In one embodiment, the color-carrying layer is an adhesive layer. The color-carrying layer includes or contains coloring elements. The coloring elements are incorporated into the color-carrying layer by dyeing the color-carrying layer with a desired color or colored pattern, printing the color-carrying layer with a desired color or color pattern, injecting the color-carrying layer with a desired color or color pattern or mixing the color-carrying layer with color pigments. The textile fabric includes a first color or first colored pattern on at least a portion of the top surface of the textile fabric, and the coloring elements incorporated into the color-carrying layer have a second color or a second colored pattern. The second color approaches, matches, is aesthetically compatible with, or is contrasting to the first color on the top surface of the textile fabric. Therefore, the color-carrying layer introduces a shade of color into the textile fabric composite that is compatible with or matches the face color or pattern of the textile fabric.

The second color incorporated into the color-carrying layer is exposed along portions of the top surface of the textile fabric that are the parted under pressure applied by embossing or traffic passing over the top surface. Exposure of the second color masks the parted portions of the top surface. In addition, the color-carrying layer may reduce or eliminate holes created in the depressed embossed areas of the textile fabric. In one embodiment, the color-carrying layer is added to the textile fabric, for example, under the textile fabric adjacent a bottom surface that is opposite the top surface, before the resulting textile fabric composite is exposed to an embossing or molding process. The embossing or molding process melts the color-carrying layer, e.g., the LMCC or LMCC adhesive layer. The melted color-carrying layer, e.g., the melted adhesive, propagates through the textile fabric toward the top surface. In one embodiment, the propagation of melted adhesive is controlled by adjusting the melt index of the adhesive, the weight of the adhesive, the applied temperature, the applied pressure and combinations thereof. These adjustments allow the melted adhesive to proceed towards the upper surface of textile fabrics having a printed color or printed color patterns, compensating for the lack of face color within the lower strata of the textile fabric and eliminating any color gaps appearing along the top surface.

In one embodiment, the color-carrying layer, including an LMCC layer and an adhesive layer, is contained within the textile fabric between the top surface and the bottom surface. Alternatively, the color-carrying layer is placed above one or more separate internal sublayers contained within the textile fabric, i.e, between the internal sublayers and the top surface. Therefore, the adhesive layer is disposed between the internal sublayers and the top surface of the textile fabric. Suitable internal sublayers include, but are not limited to, the stitching substrate of a stitched fabric, the primary backing of a tufted fabric and the reinforcing mid-layer of a needle-punched fabric. As with color-carrying layers, including LMCC or adhesive layers, placed below the bottom surface of the textile fabric, the melted color-carrying layer proceeds upwards through the fabric layer toward the colored tope surface upon embossing or molding, masking gaps along the top surface that lack color.

In one embodiment, color-carrying layer is a polymeric film or a polymeric fabric. In one embodiment, the color-carrying layer is a layer of powders or freeze ground particles mixed with color pigment. In one embodiment, the color-carrying layer is melt-extruded or coated from a solution onto the bottom surface of the textile fabric. In one embodiment, the color-carrying layer is pre-melted and pressed into the bottom surface of the textile fabric prior to molding or embossing. In one embodiment, the color-carrying layer is pre-pressed into the textile fabric, and the textile fabric is maintained at a temperature above the color-carrying layer melting point until the resulting textile fabric composite is embossed. In one embodiment, the color-carrying layer is applied in a melted state, is subsequently cooled below the color-carrying layer melting point following application or incorporation into the textile fabric and is re-melted during subsequent embossing of the resulting textile fabric composite. In one embodiment, a backing is attached to the textile fabric and color-carrying layer with embossing.

In one embodiment, the textile fabric is a woven fabric or knit fabric formed with yarns. In one embodiment, the textile fabric is a tufted fabric or stitch-bonded fabric containing yarns and a primary substrate or backing. The substrate or backing can be a fibrous substrate or backing or a non-fibrous substrate or backing. In one embodiment, the backing or substrate includes color elements or coloring compatible with the color or color scheme of the stitching or tufting yarns. In another embodiment, the backing or substrate does not include color elements or coloring.

In one embodiment the textile fabric is a needle-punched fabric, and the color-carrying layer is located or placed adjacent to the back surface of the textile fabric. In one embodiment, the needle-punched fibers penetrate the color-carrying layer. In one embodiment, the color-carrying layer is contained within the needle-punched fabric. In one embodiment, the textile fabric is a bonded or spunlaced nonwoven fabric formed with continuous filaments, staple fibers or combinations thereof.

In one embodiment, the weight of the color-carrying layer, the melt index of the color-carrying layer, or both the weight of the color-carrying layer and the melt index of the color-carrying layer are adjusted to control a degree of penetration of the melted color-carrying-layer through the textile fabric towards the top surface. In one embodiment, the color-carrying layer is an adhesive layer, and melted adhesive from the color-carrying layer layer placed adjacent the bottom surface of a tufted or stitch-bonded textile fabric penetrates the substrate or primary backing used to form the textile fabric but does not propagate completely to the top surface.

In one embodiment, the textile fabric combined with the color-carrying layer are embossed using a highly conformable and recoverably-elastic back-up tool such as silicon rubber. Use of the back-up tool allows embossing to depths approaching or exceeding a thickness of the textile fabric. In one embodiment, the color-carrying layer is an adhesive layer, and the textile fabric containing the color-carrying adhesive layer adjacent the bottom surface is attached to a highly-conformable backing during the embossing process, eliminating the need for a separate back-up tool.

In one embodiment, one or more of a proximity of the color-carrying layer to the top surface containing the color or colored pattern, the weight of the color-carrying layer, and the melt viscosity of the color-carrying layer are selected to prevent the melted color-carrying layer from reaching and stiffening the top surface while allowing the melted color-carrying layer to propagate through the textile fabric towards the colored surface. In one embodiment, the color-carrying layer is a partially-open layer with a selected pattern that rises towards the top surface of the fabric to produce a special "phantom" surface effect as the color-carrying layer becomes partially visible among the generally parted surface fibers or yarns.

Exemplary embodiments are directed to a method for producing textile fabric composite having a colored top surface. A textile fabric having a top surface and a first color disposed on at least a portion of the top surface is combined with a color-carrying layer containing a second color. The color-carrying layer is spaced from and located below the top surface. The color-carrying layer is propagated partially through the textile fabric toward the portion of the top surface containing the first color. In one embodiment, a color-carrying adhesive layer is selected as the color-carrying layer. In one embodiment, the color-carrying adhesive layer has a color-carrying adhesive layer melting point, and the textile fabric has a textile fabric melting point. The color-carrying adhesive layer melting point is lower than the textile fabric melting point. In one embodiment, a printed fabric or a film is selected as the color-carrying layer. In one embodiment, a film containing color pigments is selected as the color-carrying layer. In one embodiment, the color-carrying layer is formed using powders mixed with colored pigment or using particles mixed with colored pigment.

In one embodiment, the textile fabric includes a bottom surface opposite the top surface, and the color-carrying layer is placed on a plurality of discrete portions of the bottom surface. Placing the color-carrying layer on a plurality of discrete portions includes placing the color-carrying layer in the plurality of discrete portions in accordance with a predetermined pattern that creates a phantom effect with the first color. In one embodiment, the color-carrying layer is selected such that the second color is identical to the first color. In one embodiment, the color-carrying layer is selected such that the first color and the second color differ by one or more of hue, tint, shade, tone, saturation, lightness, chroma, intensity, brightness and grayscale.

In one embodiment, the textile fabric includes a bottom surface opposite the top surface, the color-carrying layer is applied to the bottom surface. Applying the color-carrying layer to the back surface includes melt-extruding the color-carrying layer onto the bottom surface or coating the color-carrying layer onto the bottom surface. In one embodiment, when combining the textile fabric and the color-carrying layer a distance between the color-carrying layer and the top surface is varied across the textile fabric, a thickness of the color-carrying layer is varied across the textile fabric, or a distance between the color-carrying layer and the top surface across the textile fabric and a thickness of the color-carrying layer are varied across the textile fabric. In one embodiment, the textile fabric is combined with a plurality of discrete color-carrying layers. In one embodiment, the plurality of discrete color-carrying layers are located at two or more separate distances from the top surface.

In one embodiment, the textile fabric is a stitch-bonded fabric, and the color-carrying layer is used as a substrate to form the stitch-bonded fabric. In one embodiment, the textile fabric is a stitch-bonded fabric containing a stitching substrate, and the color-carrying layer is placed against the stitching substrate such that the color-carrying layer is disposed between the stitching substrate and the top surface. In one embodiment, the textile fabric is a tufted fabric, the color-carrying layer is used as a primary backing to form the tufted fabric. In one embodiment, the textile fabric is a tufted fabric containing a primary backing, and the color-carrying layer is placed against the primary backing during tufting such that the color-carrying layer is disposed between the primary backing and the top surface. In one embodiment, a needle-punched fabric having the top surface and a bottom surface opposite the top surface is selected as the textile fabric, and the color-carrying layer is incorporated within the textile fabric between the top surface and the bottom surface.

In one embodiment, propagating the color-carrying layer through the textile fabric toward the top surface includes using a lamination process, a molding process or an embossing process. In one embodiment, the textile fabric has a bottom surface opposite the top surface, and propagating the color-carrying layer through the textile fabric involves applying heat, pressure or heat and pressure toward to the top surface, the bottom surface or the top and bottom surface.

In one embodiment, an extent of propagation of the color-carrying layer through the textile fabric toward the top surface is controlled. In one embodiment, controlling the extent of propagation includes adjusting a melt index of the color-carrying layer, adjusting a proximity of the color-carrying layer to the top surface, adjusting a weight of the color-carrying layer and combinations thereof. In one embodiment, controlling the extent of propagation includes controlling a direction of flow of the color-carrying polymer by applying compressed air, vacuum or compressed air and vacuum to the top surface, the bottom surface or both the top surface and the bottom surface. In one embodiment, compressed air, vacuum or compressed air and vacuum are applied uniformly across the textile fabric. In one embodiment, applying compressed air, vacuum or compressed air and vacuum includes varying applying compressed air, vacuum or compressed air and vacuum across the textile fabric to promote greater color-carrying layer propagation within preferred areas of the textile fabric and lesser color-carrying layer propagation in other areas of the textile fabric. In one embodiment, controlling the extent of propagation involves promoting color propagation from the color-carrying layer by increasing local pressure in selected areas using the projections of a compressing tool.

In one embodiment, the first color is disposed completely across the top surface, and the second color is disposed completely across the color-carrying layer. In one embodiment, the first color is disposed at a plurality of locations across the top surface, and the second color is located at a plurality of locations across in the color-carrying layer. The plurality of locations across the top surface are aligned with the plurality of locations in the color-carrying layer when the textile fabric is combined with the color-carrying layer. In one embodiment, a three-dimensional pattern is formed into the textile fabric composite. In one embodiment, forming the three-dimensional pattern includes forming the three-dimensional pattern after propagating the color carrying layer. In one embodiment, forming the three-dimensional pattern includes forming the three-dimensional pattern simultaneously with propagating the color-carrying layer.

Exemplary embodiments are directed to a method for producing a textile fabric composite having a colored top surface. A textile fabric with a top surface and a first color disposed on the top surface is combined with a low melting color-carrying adhesive layer having a second color. The color-carrying layer is spaced from and located below the top surface. The low melting color-carrying adhesive layer is propagated partially through the textile fabric toward the top surface containing the first color by applying heat or heat and pressure to melt the low-melting color-carrying adhesive layer and to propagate melted low-melting color-carrying adhesive through the textile fabric.

Exemplary embodiments are directed to a method for producing a textile fabric composite having a colored top surface. A textile fabric with a top surface and a first color pattern disposed on the top surface is combined with a color-carrying layer containing a second color pattern. The color-carrying layer is spaced from and located below the top surface, and the second color pattern aligned with the first color pattern and has a complementary colors to the first color pattern. The color-carrying layer is propagated partially through the textile fabric toward the top surface.

BRIEF DESCRIPTION OF THE DRAWINGS

The accompanying drawings, which are incorporated in and constitute a part of the specification, illustrate a plurality of embodiments and, together with the following descriptions, explain these embodiments.

DETAILED DESCRIPTION

The following description of the embodiments refers to the accompanying figures. The same reference numbers in different figures identify the same or similar elements. Reference throughout the whole specification to "one embodiment" or "an embodiment" means that a particular feature, structure or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment. Further, particular features, structures or characteristics may be combined in any suitable manner in one or more embodiments.

Exemplary embodiments mask color gaps that appear in the colors and color patterns that are located on at least a portion of the top surface of a textile fabric. A colored or color-carrying layer is attached to or incorporated into the textile fabric. Suitable color-carrying layers include, but are not limited to, color-carrying adhesive layers, low-melt color carrying (LMCC) layers, color-carrying polymeric films and color-carrying polymeric fabrics. The color-carrying layer contains one or more colors or color patterns. These colors include colors that are complementary to colors located on the top surface of the textile fabric and colors that are contrasting to the colors on the top surface of the textile fabrics.

In one embodiment, the top surface of the textile fabric includes a first color, and the adhesive layer contains a second color. In one embodiment, the top surface of the textile fabric is not dyed or printed. The first color and the second color are selected to provide the desired level of compatibility or contrast between the first color and the second color. Compatibility is used, for example, to provide a second color that is identical to the first color and that masks discontinuities in the first color or to provide a complimentary second color that enhances the first color. Contrast is used, for example, to provide a second color that highlights discontinuities in the first color or to provide a desired visual effect in the textile fabric. In one embodiment, a desired compatibility or contrast between the first color and second color is achieved by varying one or more of hue, tint, shade, tone, saturation, lightness, chroma, intensity, brightness and grayscale in and between the first and second colors.

Figure 1:
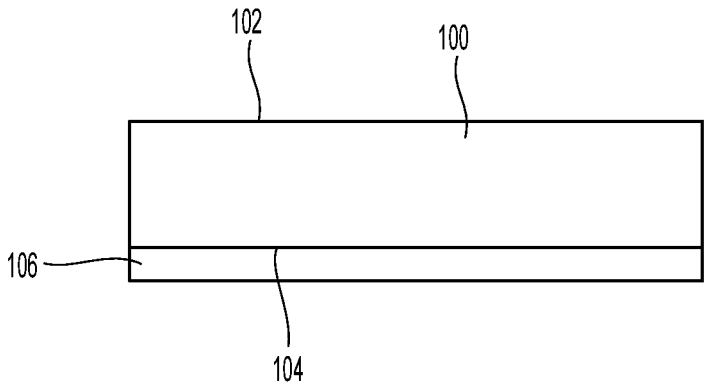
FIG. 1 is a schematic representation of an embodiment of a textile fabric and color-carrying layer attached to the bottom surface of the textile fabric.

Exemplary embodiments are directed to a method for producing a moldable and embossable textile fabric composite having a colored top surface. Referring to FIG. 1, a desired textile fabric 100 is selected. In one embodiment, selecting the textile fabric includes forming the textile fabric from a plurality of yarns. The textile fabric has a top surface 102 and a bottom surface 104 opposite the top surface. Suitable textile fabrics include, but are not limited to woven fabrics, knit fabrics, stitch-bonded fabrics, needle-punched fabrics and tufted fabrics. In one embodiment, the top surface of the textile fabric includes at least one desired color or a colored pattern. The colored pattern can utilize a single color or a combination of two or more colors. The colored pattern can also include variations in hue, tint, shade, tone, saturation, lightness, chroma, intensity, brightness and grayscale of a single color or of two or more colors. In one embodiment, at least one first color is disposed on at least a portion of the top surface. In one embodiment, the first color covers the entire top surface. Alternatively, the first color covers only a portion of the top surface and is arranged in a pre-determined pattern on the top surface. In one embodiment, a plurality of separate and distinct first colors are disposed on the top surface. The colors in the plurality of first colors are arranged on the top surface in accordance with a pre-determined desired pattern or to produce a desired effect on the top surface.

In one embodiment, in order to create the desired color or colored pattern on the top surface of the textile fabric, selecting the textile fabric includes printing the first color on the top surface. Alternatively, selecting the textile fabric includes dyeing the top surface with the first color. In one embodiment, selecting the textile fabric includes forming the textile fabric using fibers colored with the first color, yarns colored with the first color, or fibers colored with the first color and yarns colored with the first color.

Having selected a textile fabric, a colored or color-carrying layer 106 is selected. Suitable color-carrying layers include, but are not limited to, color-carrying adhesive layers, low-melt color-carrying layers (LMCC), a color-carrying polymer film and a color-carrying polymer fabric. In one embodiment, selecting the color carrying layer includes selecting a color-carrying polymeric adhesive layer. Suitable polymers for the color-carrying polymeric adhesive layer include, but are not limited to, polyolefins and low-melting polyesters. In one embodiment, the color-carrying layer has a color-carrying layer melting point, and the color-carrying layer melting point is lower than a textile fabric melting point, a fiber melting point for the fibers contained in the textile fabric, or a yarn melting point for the yarns contained in the textile fabric. Therefore, the color-carrying layer can be melted without melting the textile fabric or the fibers or yarns contained within the textile fabric.

The color-carrying layer includes at least one second color disposed on or in at least a portion of the color-carrying layer. In one embodiment, the color-carrying layer includes a plurality of separate and distinct second colors. In one embodiment, selecting the color-carrying layer includes selecting the color-carrying layer such that the second color is identical to the first color. Alternatively, the color-carrying layer is selected such that the first color and the second color differ to a pre-determined degree by one or more of hue, tint, shade, tone, saturation, lightness, chroma, intensity, brightness and grayscale. Suitable color-carrying layers include, but are not limited to, color-carrying adhesive layers, for example, a printed fabric and a film. In one embodiment, a film containing color pigments is selected as the color-carrying adhesive layer. In one embodiment, selecting the color-carrying layer includes forming the color-carrying layer using polymer powders mixed with colored pigment or polymer particles mixed with colored pigment.

Having selected the textile fabric and color-carrying layer, the textile fabric and color-carrying layer are combined to form the textile fabric composite. In one embodiment, the color-carrying layer is attached to or applied to the bottom surface 104 of the textile fabric (FIG. 1). In one embodiment, the color-carrying layer is melt-extruded onto the bottom surface. Alternatively, the color-carrying layer is a layer coated onto the bottom surface. The color-carrying layer can be placed against the bottom surface before applying additional processes to the textile fabric, for example, lamination processes, molding processes or embossing processes. Suitable lamination, molding and embossing processes for use with textile fabrics and textile fabric composites are known and available in the art. Alternatively, the color-carrying layer is applied to the bottom surface during a lamination process, a molding process, or an embossing process. In one embodiment, heat is used to pre-activate the color-carrying layer prior to combining the textile fabric and color-carrying layer. In one embodiment, the resulting textile fabric composite is cooled following lamination, molding, embossing or pre-activation.

Figure 2:
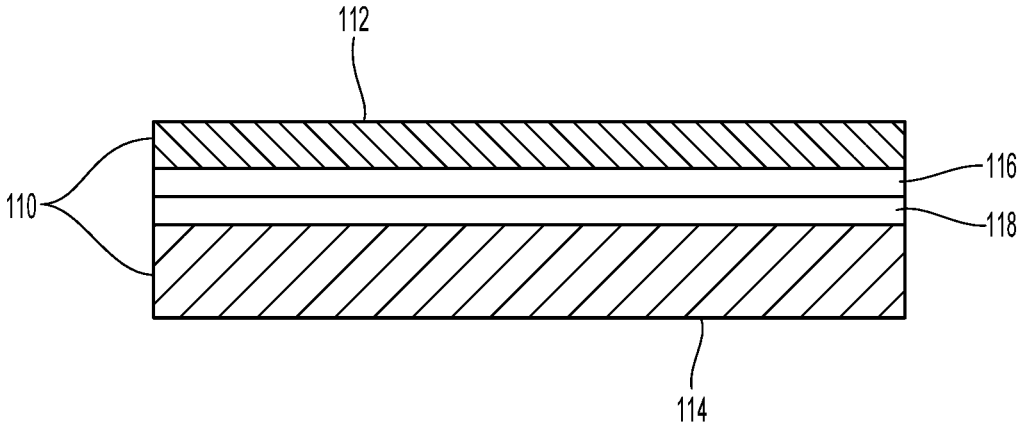
FIG. 2 is a schematic representation of an embodiment of a textile fabric containing an intermediate layer and a color-carrying layer disposed in the textile fabric between the intermediate layer and the top surface.

Referring to FIG. 2, in one embodiment, the color-carrying layer 116 is incorporated into the textile fabric 110 between the top surface 112 and the bottom surface 114. In one embodiment, the textile fabric includes one or more additional or intermediate layers 107 and 118 disposed within the textile fabric between the bottom surface to the top surface. Suitable additional layers include, but are not limited to, backing layers, primary tufting backing layers and stitch-bonding substrate layers. In one embodiment, the color-carrying layer is disposed in the textile fabric such that the color-carrying layer is disposed between the additional layers and the top surface of the textile fabric.

The color-carrying layer is propagated through the textile fabric toward the top surface. In order to propagate the color-carrying layer through the textile fabric, heat, pressure, or heat and pressure are applied to the textile fabric. In one embodiment, the heat and pressure are applied to the top surface, the bottom surface or the top surface and the bottom surface of the textile fabric. When the color-carrying layer is disposed on the bottom surface of the textile fabric, heat, pressure or heat and pressure are applied to the top surface, the color-carrying layer or the top surface of the textile fabric and the color-carrying layer. Suitable processes for applying heat and pressure to the textile fabric composite containing the textile fabric, the color-carrying layer and any additional layers include, but are not limited to, lamination processes, molding processes and embossing processes. In one embodiment, heat, pressure or heat and pressure are applied to the textile composite at a temperature above a color-carrying layer melting point and below a textile fabric melting point, i.e., the fibers and yarns of the textile fabric.

Figure 3:
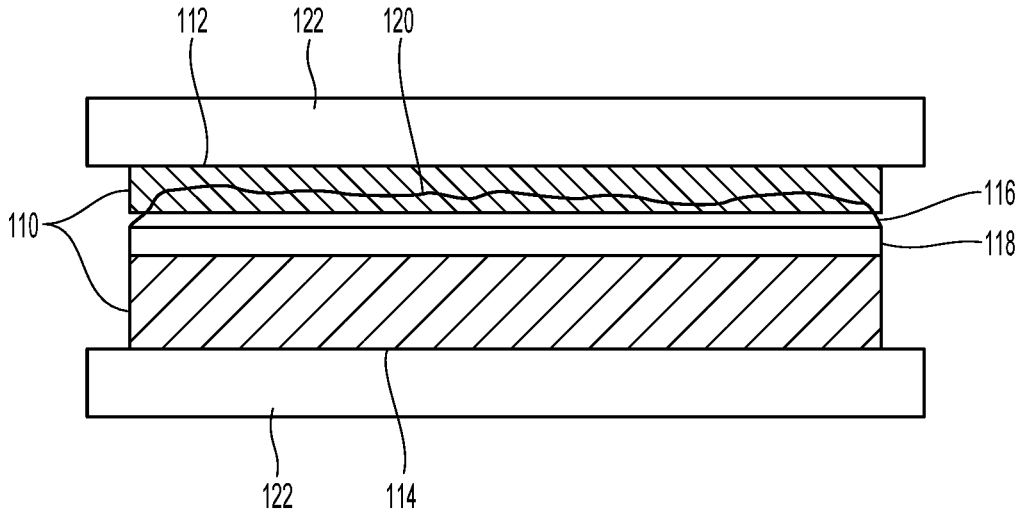
FIG. 3 is a schematic representation of the textile fabric of FIG. 2 exposed to flat lamination.

Referring to FIG. 3, in one embodiment, one or more plates 122 including one or more heated plates are applied to the textile fabric composite containing the textile fabric 110, the color-carrying layer 116 and the additional intermediate layer 118. The color-carrying layer and intermediate layer are located between the top surface 112 and the bottom surface 114 of the textile fabric. As illustrated, a first plate is applied to the top surface 112 of the textile fabric 110, and a second plate is applied to the bottom surface 114 of the textile fabric. At least the top plate 122 or both plates are heated, and pressure is applied by moving the first plate toward the second plate. The applied heat, pressure or heat and pressure produces melted color-carrying layer 120 that propagates through the fibers and yarns of the textile fabric toward to the top surface. When the color-carrying layer is a colored layer, the color-carrying layer maintains the desired color upon melting, and propagation of the melted color-carrying layer toward the top surface propagates the desired color or color pattern toward the top surface. For colored pigments or particles contained with the color-carrying layer, these pigments and particles are carried toward the top surface in the melted color-carrying layer.

Exemplary embodiments control the flow of color-carrying layers through the textile fabric toward the top surface and laterally through the textile fabric in directions parallel to the top surface. Suitable methods for controlling the flow of color-carrying layers include, but are not limited to, applying hot or cold compressed air to the bottom surface of the textile fabric, applying vacuum to the top surface of the textile fabric, varying the amount of air or heat applied to the top surface or bottom surface across the area of the top surface or bottom surface, and using color-carrying layers with higher melt indexes. In one embodiment, applied pressure is use to bring melted color-carrying layer to the top surface. In one embodiment, applied pressure is varied across the textile fabric to vary the intensity of the resulting color. Varying pressure can be accomplished using an embossing pattern containing high points and low points. In one embodiment compressed air is directed into the textile fabric from the bottom surface to propel the melted color-carrying layer towards the top surface to promote vertical or normal propagation versus lateral propagation of the melted color-carrying layer and to avoid losing sharpness in the colored patterns. In one embodiment, vacuum is applied from the top surface to promote vertical propagation. In one embodiment, the melt index of the molten color-carrying layer is raised to cause rapid propagation towards the heat source applied from the top surface. In one embodiment air or vacuum are applied in a planarly variable manner to promote greater color-carrying layer propagation within preferred areas of the textile fabric and lesser color-carrying layer propagation in other areas of the textile fabric. In one embodiment, controlling the extent of propagation involves promoting color propagation from the molten color-carrying layer by increasing local pressure in selected areas of the textile fabric using the projections of a heated compressing tool. The projections of the compression tool may or may not create depressions on the surface depending upon the depth of the projections and the temperature of the surface of the tool.

Figure 4:
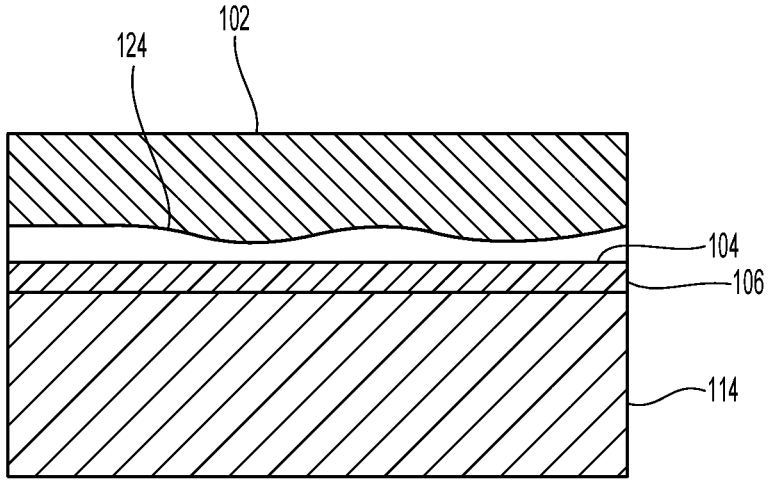
FIG. 4 is a schematic representation of an embodiment of a textile fabric and color-carrying layer following exposure to flat lamination with a backing layer attached.

Referring now to FIG. 4, in one embodiment, the color-carrying layer 106 is attached to the bottom surface 104 of the textile fabric 100 or placed against the bottom surface. Heat, pressure or heat and pressure are then applied to the top surface 102, and the color-carrying layer propagates through the textile fabric toward to the top surface 102. A backing layer 114 is included in the textile fabric composite by attaching the backing layer via the adhesive layer to the bottom surface of the textile fabric 104. The attachment may occur before or during a lamination, molding or embossing process used to apply heat and pressure to the textile fabric and color-carrying layer or to bond the backing layer to the textile fabric and color-carrying layer. The melted color-carrying layer 106, e.g., the melted color-carrying adhesive, migrates through the textile fabric toward the top surface 124 away from the backing layer 114. In addition to migrating through the textile fabric, the adhesive layer secures the backing layer to the textile fabric. Suitable backing layers are known and available in the art.

Figure 5:
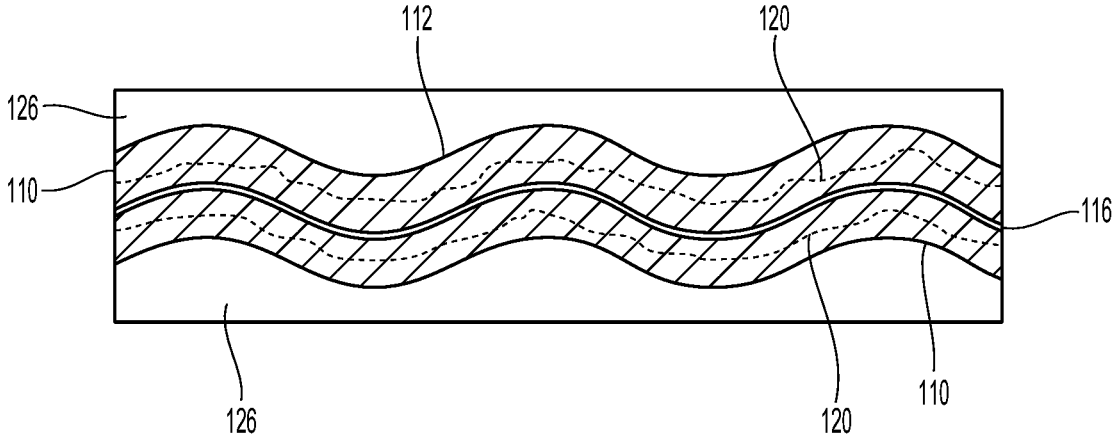
FIG. 5 is a schematic representation of a textile fabric containing a color-carrying, exposed to embossing with a three-dimensional pattern.

As illustrated in FIG. 3, flat or planar plates are optionally used to apply the heat and pressure to the textile fabric composite containing the textile fabric, color-carrying layer and any intermediate or backing layers. Therefore, the textile fabric composite is subjected to flat lamination. However, as illustrated in FIG. 5, alternative types of lamination, molding and embossing with heated surfaces having three dimensional patterns are also used to apply heat and pressure to propagate the color-carrying layer toward the top surface. The three-dimensional patterns can be applied after an initially flat lamination or concurrent with combining or laminating together the components of the textile fabric composite. In one embodiment, a three-dimensional pattern is molded into the textile fabric composite following flat lamination. Alternatively, propagating the color-carrying layer through the textile fabric toward the top surface is accomplished while embossing the textile fabric and laminated color-carrying layer with a deep pattern.

Referring to FIG. 5, in one embodiment, the textile composite includes the textile fabric 110 and the color-carrying layer 116 disposed between the topo surface or top layer 112 and the bottom surface or bottom layer 114 of a composite textile fabric. One or more plates 116 each having a desired three-dimensional shape or pattern created by textured or curved surfaces are brought into contact with the top surface, the bottom surface or the top surface and the bottom surface to apply heat, pressure or heat and pressure to those surfaces. Therefore, the desired three-dimensional shape is embossed or molded into the textile fabric composite. The three-dimensional shape imparts a desired aesthetic or texture into the textile fabric composite. The applied heat, pressure or heat and pressure produces melted color-carrying layer 120 that propagates through the fibers and yarns of the textile fabric toward to the heated top surface 112, toward the heated bottom surface 114 or toward to the heated top surface 112 and toward the heated bottom surface 114 of the textile fabric.

To prevent the melted color-carrying layer from propagating far enough toward the top surface of the textile fabric to affect the feel and flexibility of the top surface adversely and to affect the colors or colored patterns in the color-carrying layer adversely, a depth or extend of propagation of the color-carrying layer through the textile fabric toward the top surface is controlled. The colors or color patterns are adversely affected, for example, when the tone of the colors change or the patterns in the color patterns change. In one embodiment, controlling the depth of propagation includes adjusting a melt index of the color-carrying layer, adjusting a proximity, i.e., an initial distance, of the color-carrying layer to the top surface, adjusting a weight of the color-carrying layer and combinations thereof. In general, the melted color-carrying layer is propagated far enough through the textile fabric toward the top surface to position the color, colors or color pattern associated with the color-carrying layer at a depth below the top surface sufficient to mask gaps appearing in colors or color patterns on the top surface. Such gaps appear along the top surface of the textile fabric as a result, for example, of three-dimensional patterns applied to or molded into the textile fabric. In another embodiment, the color, colors or color pattern is propagated to a depth to provide desired complimentary color effects between any first color located on the top surface and any second color contained in the color-carrying layer.

Figure 6:
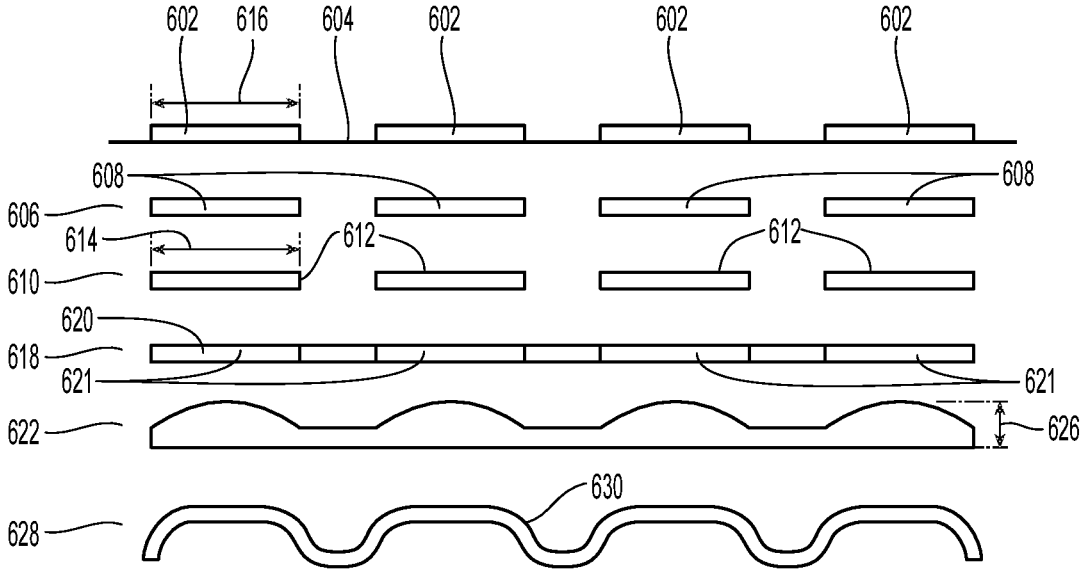
FIG. 6 is a schematic representation of variations in arrangements of color-carrying layers incorporated into a textile fabric having colors on the top surface.

In addition to using the depth of penetration to provide the desired masking or complementary coloring, the position and extent of the second color or the plurality of second colors in directions parallel to the top surface of the textile fabric are also controlled. Referring to FIG. 6, wherein the textile fabric has a first color 602 on the top surface 604, a plurality of second colors originating from a low melt color-carrying layer are placed at a plurality of discrete locations below the top surface 604 of the textile fabric. As an alternative, the low melt color-carrying layer carries a uniform second color. In one embodiment, the color-carrying layer 606 containing the second color is placed as a plurality of discrete portions 608 on the bottom surface or incorporated in a plurality of discrete locations between the bottom surface and the top surface of the textile fabric. These discrete locations can be at the same depth and can have the same dimensions or can vary along one or more of depth, width and length of the textile fabric, i.e., in three dimensions. In one embodiment, each discrete location contains an identical second color. In another embodiment, two or more of the discrete locations include second colors that vary in one or more of hue, tint, shade, tone, saturation, lightness, chroma, intensity, brightness and grayscale. In one embodiment, the plurality of discrete locations of the color-carrying layer correspond to the locations and variations in the first color or first colors applied to the top surface. In one embodiment, the discrete portions are incorporated into the textile fabric in accordance with a predetermined pattern that creates a phantom effect with the first color. In one embodiment, the color-carrying layer 610 is applied as a plurality of discrete portions 612 within the textile fabric or on the bottom surface of the textile fabric. Each discrete portion has dimensions 614 that exceed the corresponding dimensions 616 of the first color portions. Therefore, the second colors, as they propagate through the textile fabric cover areas that exceed the areas occupied by the first color portions. This produces a phantom effect.

In addition to including one or more second colors in a plurality of discrete locations, in one embodiment the color-carrying layer can 618 be applied as a continuous layer 620. The continuous layer can have a continuous or uniform color. In one embodiment, the color-carrying layer is continuous, but the second color, or plurality of second colors, is located in the color-carrying layer at a plurality of locations 621 within the color-carrying layer. In one embodiment, the color-carrying layer 622 is applied as a continuous layer 624 that varies in thickness 626 across the length and width of the textile fabric. In one embodiment, the thicker regions correspond to the locations of first colors on the top surface. In one embodiment, that color-carrying layer 628 is applied as a continuous layer 630 having a generally uniform thickness but with a distance from the top surface that varies across the length and width of the textile fabric. In one embodiment this color-carrying layer has a desired three-dimensional pattern that provides the variations in depth from the top surface. In one embodiment, the shorter distances correspond to the location of the first colors on the top surface. In addition to varying the thickness and distance of the color-carrying layer, the color or color properties of the color-carrying layer can be varied across the length and width of the textile fabric. In one embodiment, a plurality of color-carrying layers is included in the textile fabric. These color-carrying layers can be identical layers or different layers and can vary in depth from the top surface, area covered and alignment with the first color patterns. The color-carrying layers can overlap or can occupy discrete locations within the textile fabric. In one embodiment, each color-carrying layer includes a distinct color or arrangement of colors. Any one of the color-carrying 120 layers describe herein can be used as one or more of the plurality of color-carrying layers included in the textile fabric composite.

Figure 7:
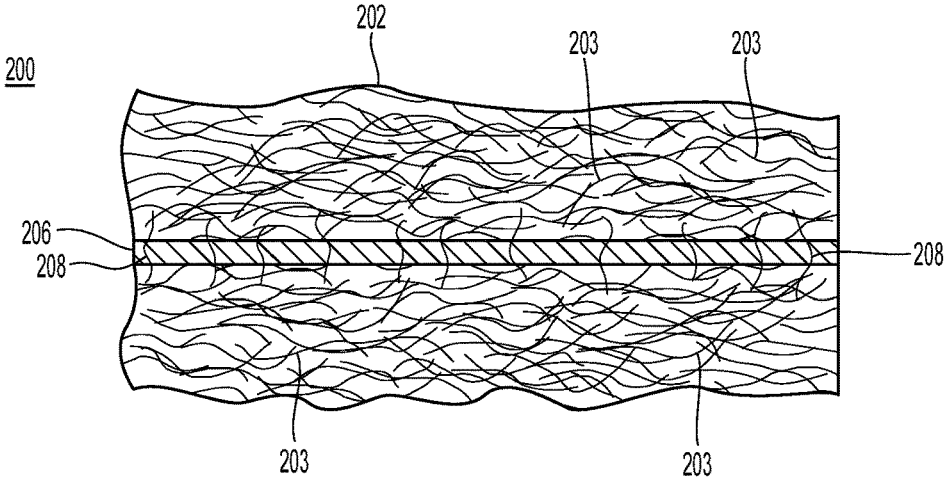
FIG. 7 is a schematic representation of an embodiment of a needle-punched fabric containing a color-carrying layer between the top surface and the bottom surface.

Referring to FIG. 7, in one embodiment, the textile fabric composite 200 is formed by selecting or creating a needle-punched fabric 201. The needle punched fabric includes a plurality of fibers 203 disposed between a top surface 202 and a bottom surface 204 opposite the top surface. In one embodiment, the color-carrying layer 206 is incorporated within the textile fabric between the top surface and the bottom surface. Alternatively, the color-carrying layer is attached to the bottom surface of the needle-punched fabric. For either incorporation of the color-carrying layer between the top surface and the bottom surface or attachment of the color-carrying layer to the bottom surface, a plurality of fibers 208 are needle-punched through the color-carrying layer. Then the color-carrying layer is propagated toward the top surface, the bottom surface of both the top surface and bottom surface using the application of heat, pressure or heat and pressure.

Figure 8:
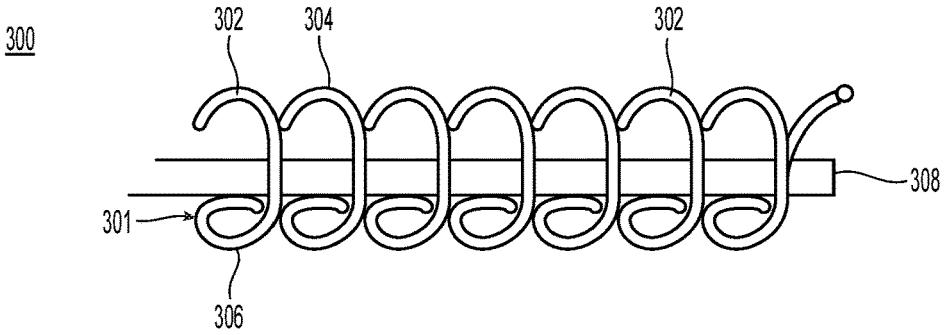
FIG. 8 is a schematic representation of an embodiment of a stitched-bonded fabric containing a color-carrying layer as the substrate.

Referring to FIG. 8, in one embodiment, the textile fabric composite 300 is formed by selecting or creating a stitch-bonded fabric 301 formed from a plurality of yarns 302. The stich-bonded fabric includes a top surface 304 and a bottom surface 306 opposite the top surface. In one embodiment as illustrated, the color-carrying layer is combined with or into the textile fabric by positioning the color-carrying layer 308 as the substrate of the stitch-bonded fabric through which the yarns are stitched. Therefore, combining the color-carrying layer is accomplished simultaneously with creating the stitch-bonded fabric. In one embodiment, colored yarns containing the first color are stitched through the color-carrying layer substrate to form the stitch-bonded fabric. Alternatively, the yarns are printed with the first color after stitch-bonding. Then the color-carrying layer is propagated toward the top surface, the bottom surface or both the top surface and bottom surface using the application of heat, pressure or heat and pressure, for example, by selecting the location and application of heat and pressure facilitating the propulsion of molten color-carrying polymer towards one or the other surface.

Figure 9:
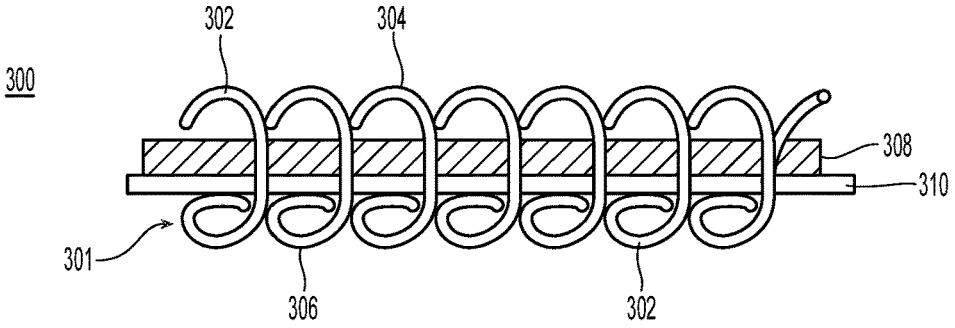
FIG. 9 is a schematic representation of an embodiment of a stitched-bonded fabric containing a substrate and a color-carrying layer disposed between the substrate and the top surface.

Referring to FIG. 9, in one embodiment, the stitch-bonded fabric 301 also includes a stitching substrate 310 separate from the adhesive layer 308. Therefore, to combine the textile fabric and adhesive layer, the adhesive layer is placed against the stitching substrate such that the adhesive layer is disposed between the stitching substrate and the top surface 304. Therefore, combining the color-carrying layer is accomplished simultaneously with creating the stitch-bonded fabric with a stitching substrate. In one embodiment, colored yarns containing the first color are stitched through the color-carrying layer and stitching substrate to form the stitch-bonded fabric. Alternatively, the yarns are printed with the first color after stitch-bonding. Location of the color-carrying layer between the top surface and the stitching substrate provides for migration of the melted color-carrying layer toward the top surface. Therefore, the color-carrying layer is propagated toward the top surface using the application of heat, pressure or heat and pressure.

Figure 10:
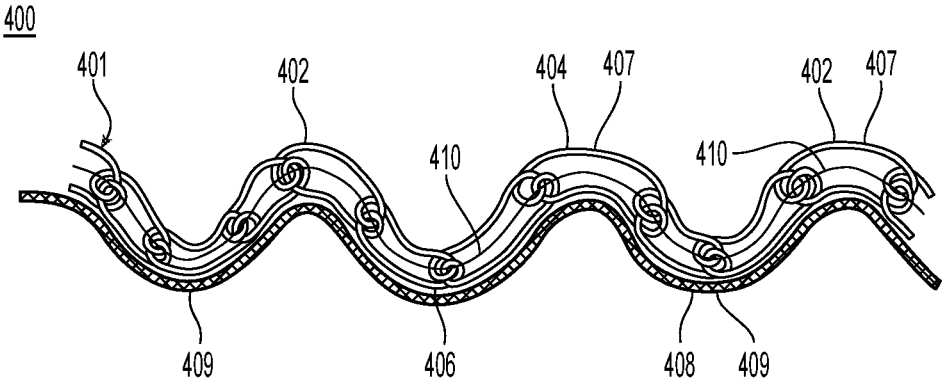
FIG. 10 is a schematic representation of an embodiment of a knit fabric having a color-carrying layer attached to the bottom surface and embossed with a three-dimensional pattern.

Referring to FIG. 10, in one embodiment, the textile fabric composite 400 is formed by selecting or creating a woven or knit fabric 401 formed from a plurality of yarns 402 and having a top surface 404 and a bottom surface 406 opposite the top surface. As illustrated, the textile fabric is combined with the color-carrying layer by positioning the color-carrying layer 408 against the bottom surface of the woven or knit fabric. The textile fabric composite is embossed or molded with a three-dimensional pattern having raised areas 407 and lowered areas 409. The color-carrying layer is attached to bottom surface either before or during embossing or forming the three-dimensional pattern in the woven or knit fabric. In addition, colored melted color-carrying layer 410 propagates through the woven or knit fabric toward the top surface. In one embodiment, colored yarns containing the first color are used to form the woven or knit fabric. Alternatively, the yarns are printed with the first color after the fabric is formed.

Figure 11:
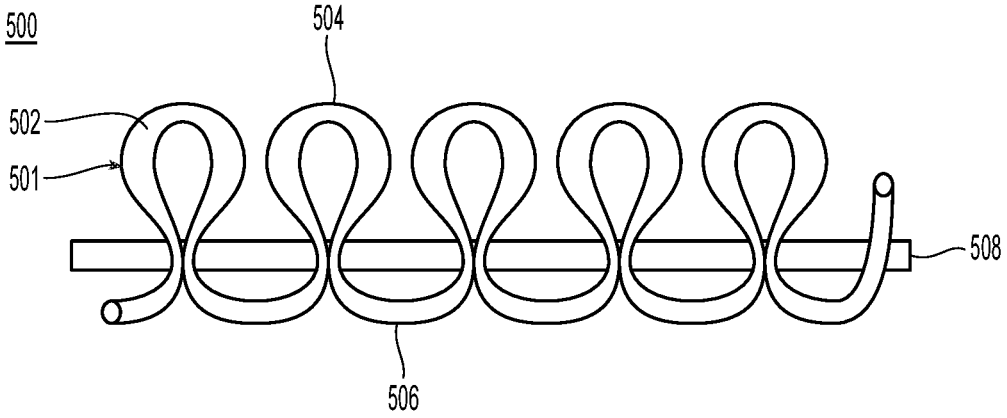
FIG. 11 is a schematic representation of an embodiment of a tufted fabric with a color-carrying layer as a primary backing.

Referring to FIG. 11, in one embodiment, the textile fabric composite 500 is formed by selecting or creating a textile fabric that is a tufted fabric 501 having a top surface 504 and a bottom surface 506. As illustrated, the textile fabric and color-carrying layer are combined by using the color-carrying layer 508 as the primary backing of the tufted fabric though which the yarns 502 are tufted. In one embodiment, colored yarns having the first color are used to form the tufted fabric. Alternatively, the yarns are printed with the first color after tufting. Therefore, combining the color-carrying layer is accomplished simultaneously with creating the tufted fabric and resulting textile fabric composite. Then the color-carrying layer is then propagated toward the top surface, the bottom surface of both the top surface and bottom surface using the application of heat, pressure or heat and pressure.

Figure 12:
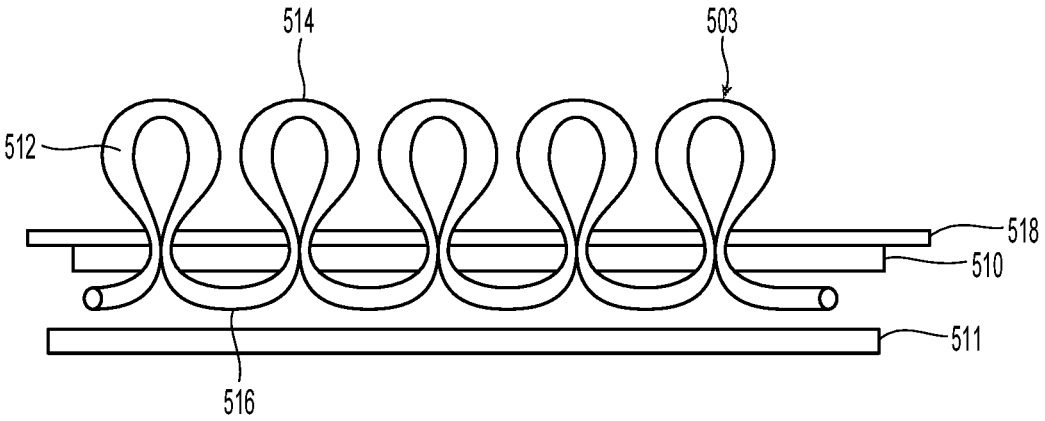
FIG. 12 is a schematic representation of an embodiment of a tufted fabric having a primary backing and a color-carrying layer disposed between the primary backing and the top surface.

Referring to FIG. 12, in one embodiment, the tufted fabric 503 includes a primary backing 510, and the textile fabric and color-carrying layer 518 are combined by placing the color-carrying layer against the primary backing during the tufting process such that the yarns 512 pass through the primary backing and the color-carrying layer and the color-carrying layer is disposed between the primary backing and the top surface 514. Therefore, combining the color-carrying layer is accomplished simultaneously with creating the tufted fabric with the primary backing. In one embodiment, colored yarns containing the first color are tufted through the color-carrying layer and primary backing to form the tufted fabric. Alternatively, the yarns are printed with the first color after tufting. Location of the color-carrying layer between the top surface and the primary backing provides for migration of the melted color-carrying layer toward the top surface. Therefore, the color-carrying layer is propagated toward the top surface using the application of heat, pressure or heat and pressure. In one embodiment, the color-carrying layer, an adhesive layer, or another backing layer 511 is placed against the bottom surface 516 of the tufted fabric formed with the primary backing 510. In one embodiment, the primary backing is an adhesive layer. Alternatively, the primary backing is a conventional primary backing.

Exemplary embodiments are directed to a method for producing a textile fabric composite having a colored top surface. A textile fabric having a top surface and a first color disposed on the top surface is combined with a color-carrying layer having a second color. In one embodiment, the first color is disposed on at least a portion of the top surface. Alternatively, the first color is disposed across the entire top surface. In one embodiment, a first color pattern is disposed on the top surface. In one embodiment, a plurality of first colors are disposed on the top surface. Similarly, the color-carrying layer can have the second color disposed throughout the color-carrying layer or in at least a portion of the color-carrying layer. In one embodiment, a second color pattern is contained in the color-carrying layer. The second color can be an identical color, a complementary color or a contrasting color to the first color. Similarly, the second color pattern can be an identical color pattern, a complementary color pattern or a contrasting color pattern to the first color pattern. In one embodiment, the color-carrying layer is selected such that the first color and the second color differ by one or more of hue, tint, shade, tone, saturation, lightness, chroma, intensity, brightness and grayscale.

In one embodiment, a color-carrying adhesive layer is selected as the color-carrying layer. In one embodiment, a low melt color carrying-layer or a low melt color-carrying adhesive layer is selected as the color-carrying layer. Other suitable selections for the color-carrying layer include, but are not limited to, a printed fabric, a film, and a film containing color pigments. In one embodiment, the color-carrying layer is formed using powders mixed with colored pigment. Alternatively, the color-carrying layer is formed using particles mixed with colored pigment. In one embodiment, the color-carrying adhesive layer has a color-carrying adhesive layer melting point, and the textile fabric has a textile fabric melting point. The color-carrying adhesive layer melting point is lower than the textile fabric melting point. Therefore, the color-carrying layer can be melted without melting the fibers or yarns of the textile fabric.

The color-carrying layer is spaced from and located below the top surface. In one embodiment, the color-carrying layer is located on a bottom surface of the textile fabric opposite the top surface, for example, by applying the color-carrying layer to the bottom surface. The color-carrying layer can be applied to the bottom surface by melt-extruding the color-carrying layer onto the bottom surface or coating the color-carrying layer onto the bottom surface. Alternatively, the color-carrying layer is located between the top surface and the bottom surface. In one embodiment, the color-carrying layer is placed on a plurality of discrete portions of the bottom surface. For example, the color-carrying layer in the plurality of discrete portions is placed in accordance with a predetermined pattern that creates a phantom effect with the first color. In one embodiment, the first color is disposed at a plurality of locations across the top surface, and the second color is located at a plurality of locations across in the color-carrying layer. The plurality of locations across the top surface align with the plurality of locations in the color-carrying layer when the textile fabric is combined with the color-carrying layer. The textile fabric can be combined with a plurality of discrete color-carrying layers. The plurality of discrete color-carrying layers can be located at two or more separate distances from the top surface and at different locations across the textile fabric. When combining the textile fabric with the color-carrying layer comprises a distance between the color-carrying layer and the top surface across the textile fabric can be varied, or a thickness of the color-carrying layer across the textile fabric can be varied. In one embodiment, a distance between the color-carrying layer and the top surface across the textile fabric and a thickness of the color-carrying layer across the textile fabric are varied.

In one embodiment, when the textile fabric is a stitch-bonded fabric, the color-carrying layer is used as a substrate to form the stitch-bonded fabric. Alternatively, the color-carrying layer is placed against the stitching substrate such that the color-carrying layer is disposed between the stitching substrate and the top surface. In one embodiment, when the textile fabric is a tufted fabric, the color-carrying layer is used as a primary backing to form the tufted fabric. Alternatively, the color-carrying layer is placed against the primary backing during tufting such that the color-carrying layer is disposed between the primary backing and the top surface. In one embodiment, when the textile fabric is a needle-punched fabric, the color-carrying layer is incorporated within the needle-punch fabric between the top surface and the bottom surface.

The color-carrying layer is then partially propagated through the textile fabric toward top surface, for example toward the portion or portions of the top surface containing the first color. Propagation of the color-carrying layer is accomplished by directing heat, pressure or heat and pressure toward the top surface, bottom surface or the top and bottom surfaces of the textile fabric. In one embodiment, heat or heat and pressure are applied to melt the color carrying layer such as a low-melting color-carrying adhesive layer and to propagate melted color carrying layer or low-melting color-carrying adhesive through the textile fabric. In one embodiment a lamination process, a molding process or an embossing process is used to propagate the color-carrying layer toward to top surface. A three-dimensional pattern can be formed in the textile fabric composite, either after propagating the color carrying layer or simultaneously with propagating the color-carrying layer. During propagation of the color-carrying layer through the textile fabric, the extent of propagation of the color-carrying layer through the textile fabric toward the top surface can be controlled. The extent of propagation can be controlled by adjusting a melt index of the color-carrying layer, adjusting a proximity of the color-carrying layer to the top surface, adjusting a weight of the color-carrying layer and combinations thereof. The extent of propagation can also be controlled by applying compressed air or vacuum to one of the top surface and the bottom surface to promote molten flow in a preferred direction.

The foregoing written description uses examples of the subject matter disclosed to enable any person skilled in the art to practice the same, including making and using any devices or systems and performing any incorporated methods. The patentable scope of the subject matter is defined by the claims, and may include other examples that occur to those skilled in the art. Such other examples are intended to be within the scope of the claims.

What is claimed is:

1. A method for producing textile fabric composite having a colored top surface, the method comprising:

combining a textile fabric comprising a top surface and a first color disposed on at least a portion of the top surface with a color-carrying layer comprising a second color, the color-carrying layer spaced from and located below the top surface; and propagating the color-carrying layer partially through the textile fabric toward the portion of the top surface containing the first color.

2. The method of claim 1, wherein the method further comprises selecting a color-carrying adhesive layer as the color-carrying layer.

3. The method of claim 2, wherein the color-carrying adhesive layer comprises a color-carrying adhesive layer melting point, the textile fabric comprises a textile fabric melting point, and the color-carrying adhesive layer melting point is lower than the textile fabric melting point.

4. The method of claim 1, wherein the method further comprises selecting a printed fabric as the color-carrying layer or selecting a film as the color-carrying layer.

5. The method of claim 1, wherein the method further comprises selecting a film containing color pigments as the color-carrying layer.

6. The method of claim 1, wherein the method further comprises forming the color-carrying layer using powders mixed with colored pigment or forming the color-carrying layer using particles mixed with colored pigment.

7. The method of claim 1, wherein:

the textile fabric comprises a bottom surface opposite the top surface; and combining the textile fabric and color-carrying layer comprises placing the color-carrying layer on a plurality of discrete portions of the bottom surface.

8. The method of claim 7, wherein placing the color-carrying layer on a plurality of discrete portions comprises placing the color-carrying layer in the plurality of discrete portions in accordance with a predetermined pattern that creates a phantom effect with the first color.

9. The method of claim 1, wherein the method further comprises selecting the color-carrying layer such that the second color is identical to the first color.

10. The method of claim 1, wherein the method further comprises selecting the color-carrying layer such that the first color and the second color differ by one or more of hue, tint, shade, tone, saturation, lightness, chroma, intensity, brightness and grayscale.

11. The method of claim 1, wherein:

the textile fabric comprises a bottom surface opposite the top surface; and combining the textile fabric and color-carrying layer comprises applying the color-carrying layer to the bottom surface.

12. The method of claim 11, wherein applying the color-carrying layer to the back surface comprises melt-extruding the color-carrying layer onto the bottom surface or coating the color-carrying layer onto the bottom surface.

13. The method of claim 1, wherein combining the textile fabric with the color-carrying layer comprises varying a distance between the color-carrying layer and the top surface across the textile fabric, varying a thickness of the color-carrying layer across the textile fabric, or varying a distance between the color-carrying layer and the top surface across the textile fabric and varying a thickness of the color-carrying layer across the textile fabric.

14. The method of claim 1, wherein combining the textile fabric with the color-carrying layer further comprises combining the textile fabric with a plurality of discrete color-carrying layers.

15. The method of claim 14, wherein combining the textile fabric with a plurality of discrete color-carrying layers comprising locating the plurality of discrete color-carrying layer at two or more separate distances from the top surface.

16. The method of claim 1, wherein:

the textile fabric comprises a stitch-bonded fabric; and combining the textile fabric and color-carrying layer comprises using the color-carrying layer as a substrate to form the stitch-bonded fabric.

17. The method of claim 1, wherein:

the textile fabric comprises a stitch-bonded fabric comprising a stitching substrate; and combining the textile fabric and color-carrying layer comprises placing the color-carrying layer against the stitching substrate such that the color-carrying layer is disposed between the stitching substrate and the top surface.

18. The method of claim 1, wherein:

the textile fabric comprises a tufted fabric; and combining the textile fabric and color-carrying layer comprises using the color-carrying layer as a primary backing to form the tufted fabric.

19. The method of claim 1, wherein:

the textile fabric comprises a tufted fabric comprising a primary backing; and combining the textile fabric and color-carrying layer comprising placing the color-carrying layer against the primary backing during tufting such that the color-carrying layer is disposed between the primary backing and the top surface.

20. The method of claim 1, wherein:

selecting the textile fabric comprises selecting a needle-punched fabric comprising the top surface and a bottom surface opposite the top surface; and combining the textile fabric and color-carrying layer comprises incorporating the color-carrying layer within the textile fabric between the top surface and the bottom surface.

21. The method of claim 1, wherein propagating the color-carrying layer through the textile fabric toward the top surface comprises using a lamination process, a molding process or an embossing process.

22. The method of claim 1, wherein:

the textile fabric comprises a bottom surface opposite the top surface; and propagating the color-carrying layer through the textile fabric comprises applying heat, pressure or heat and pressure toward to the top surface, the bottom surface or the top and bottom surface.

23. The method of claim 1, wherein the method further comprises controlling an extent of propagation of the color-carrying layer through the textile fabric toward the top surface.

24. The method of claim 23, wherein controlling the extent of propagation comprises adjusting a melt index of the color-carrying layer, adjusting a proximity of the color-carrying layer to the top surface, adjusting a weight of the color-carrying layer or combinations thereof.

25. The method of claim 23, wherein controlling the extent of propagation comprises controlling a direction of flow of the color-carrying polymer by applying compressed air, vacuum or compressed air and vacuum to the top surface, the bottom surface or both the top surface and the bottom surface.

26. The method of claim 25, wherein applying compressed air, vacuum or compressed air and vacuum comprises applying compressed air, vacuum or compressed air and vacuum uniformly across the textile fabric.

27. The method of claim 25, wherein applying compressed air, vacuum or compressed air and vacuum comprises varying applying compressed air, vacuum or compressed air and vacuum across the textile fabric to promote greater color-carrying layer propagation within selected areas of the textile fabric and lesser color-carrying layer propagation in other areas of the textile fabric.

28. The method of claim 23, wherein controlling the extent of propagation comprises promoting color propagation from the color-carrying layer by increasing local pressure in selected areas using the projections of a compressing tool.

29. The method of claim 1, wherein the first color is disposed completely across the top surface and the second color is disposed completely across the color-carrying layer.

30. The method of claim 1, the first color is disposed at a plurality of locations across the top surface and the second color is located at a plurality of locations across in the color-carrying layer, the plurality of locations across the top surface aligned with the plurality of locations in the color-carrying layer when the textile fabric is combined with the color-carrying layer.

31. The method of claim 1, further comprising forming a three-dimensional pattern into the textile fabric composite.

32. The method of claim 31, wherein forming the three-dimensional pattern comprises forming the three-dimensional pattern after proparating the color carrying layer.

33. The method of claim 31, wherein forming the three-dimensional pattern comprises forming the three-dimensional pattern simultaneously with propagating the color-carrying layer.

34. A method for producing a textile fabric composite having a colored top surface, the method comprising:

combining a textile fabric comprising a top surface and a first color disposed on the top surface with a low melting color-carrying adhesive layer comprising a second color, the color-carrying layer spaced from and located below the top surface; and propagating the low melting color-carrying adhesive layer partially through the textile fabric toward the top surface containing the first color by applying heat or heat and pressure to melt the low-melting color-carrying adhesive layer and to propagate melted low-melting color-carrying adhesive through the textile fabric.

35. A method for producing a textile fabric composite having a colored top surface, the method comprising:

combining a textile fabric comprising a top surface and a first color pattern disposed on the top surface with a color-carrying layer comprising a second color pattern, the color-carrying layer spaced from and located below the top surface and the second color pattern aligned with the first color pattern and comprising a complementary colors to the first color pattern; and propagating the color-carrying layer partially through the textile fabric toward the top surface.

* * * * *